United States Patent [19]

Willis

[11] Patent Number: 4,540,100

[45] Date of Patent: Sep. 10, 1985

[54] DEVICE FOR ATTACHING A FITMENT TO A CONTAINER

[75] Inventor: W. C. Willis, Hagerstown, Ind.

[73] Assignee: Aluminum Company of America, Pittsburgh, Pa.

[21] Appl. No.: 597,024

[22] Filed: Apr. 5, 1984

Related U.S. Application Data

[62] Division of Ser. No. 470,477, Feb. 28, 1983, Pat. No. 4,454,954.

[51] Int. Cl.[3] ..... B65D 41/34

[52] U.S. Cl. ..... 215/252; 215/28

[58] Field of Search ..... 215/28, 29, 26, 21, 215/22, 252

[56] References Cited

U.S. PATENT DOCUMENTS 3,158,278 11/1964 Knapp et al. ..... 215/252
4,205,755 6/1980 de Wijn ..... 215/252

FOREIGN PATENT DOCUMENTS 2502271 7/1975 Fed. Rep. of Germany ..... 215/28
659640 1/1964 Italy ..... 215/252

*Primary Examiner*—Donald F. Norton
*Attorney, Agent, or Firm*—Max L. Williamson

[57] ABSTRACT

A device for attaching a fitment to an open mouth container and for tamper-evident sealing of the fitment with the fitment attached thereto. The device includes a closure portion having a first skirt portion adapted for rolling a thread to engage a cooperating thread on the fitment. Other skirt portions are adapted for rolling such portions into engagement with the fitment and the container to firmly attach the fitment to the container, and a fracturable line of weakening is provided between the first skirt portion and the other skirt portions to provide evidence that the container has been opened upon a first unthreading of the closure.

9 Claims, 5 Drawing Figures

DEVICE FOR ATTACHING A FITMENT TO A CONTAINER

CROSS-REFERENCE TO RELATED APPLICATIONS

This application is a division of application Ser. No. 470,477, filed Feb. 28, 1983 now U.S. Pat. No. 4,454,954.

BACKGROUND OF THE INVENTION

This invention relates to a device for attaching a fitment to an open mouth container, which device also includes a closure for sealing the container.

Fitments are devices that are adapted for attachment to the open mouth of the container to perform a variety of functions, such as altering the manner or type of flow of the contents from the container. One well-known type of fitment is a nonrefillable pour fitment which is adapted to prevent fraudulent addition to or replacement of a container's content. Examples of such fitments are described in Fisher U.S. Pat. No. 2,378,919, Lepri U.S. Pat. No. 2,850,192, Greene U.S. Pat. No. 3,073,470 and Bereziat U.S. Pat. No. 3,861,548. The fitment may be adapted to fit completely within a neck portion of the container, as is shown in the Fisher patent, or it may be adapted to attach in some manner with an outer portion of the container, as shown by Lepri and Bereziat.

It would be desirable to provide a device for attaching a fitment to a container which included an attaching feature as well as a tamper-evident closure.

BRIEF SUMMARY OF THE INVENTION

A device of this invention comprises a top wall and a depending skirt. In a first skirt portion adjacent the top wall a continuous thread is provided to engage with a cooperating thread on a fitment coaxially positioned on the open container mouth. The top wall and first depending skirt portion comprise a closure portion of the invention. A second skirt portion is separated from the first skirt portion by a frangible portion which is adapted to fracture when the closure is removed from the fitment. The second skirt portion includes means for engaging the fitment to prevent vertical movement of the second skirt portion when the closure is disengaged from the fitment. A third skirt portion depending from the second portion is provided with an inward flange at or near the open end of the skirt to engage a flange projecting outwardly from the container and may also include a plurality of inwardly projecting tongues to engage a portion of the flange. The combination of the fitment engaging means in the second skirt portion and the flange engagements of the third skirt portion with the container provides a tight, firm attachment of the fitment to the container.

It is an object of this invention to provide a reliable attachment of a fitment to a container.

It is also an object of this invention to provide a tamper-evident closure for a fitment attached to a container.

It is a further object of this invention that the foregoing attachment and closure features be combined in a single device which is economical to make and apply to the fitment and container combination.

These and other objects and advantages of this invention will be more readily apparent with reference to the following description of a preferred embodiment and the appended drawings.

DESCRIPTION OF A PREFERRED EMBODIMENT

For purposes of illustration, a preferred embodiment of a device of this invention is described with respect to assembling the fitment described in my copending application Ser. No. 470,477 to a container. It is to be understood that a device of this invention is not limited to use with such fitment, and it is intended that the scope of the invention includes its use with any fitment suitably adapted for assembly with the invention in accordance with the following description.

Figure 1:
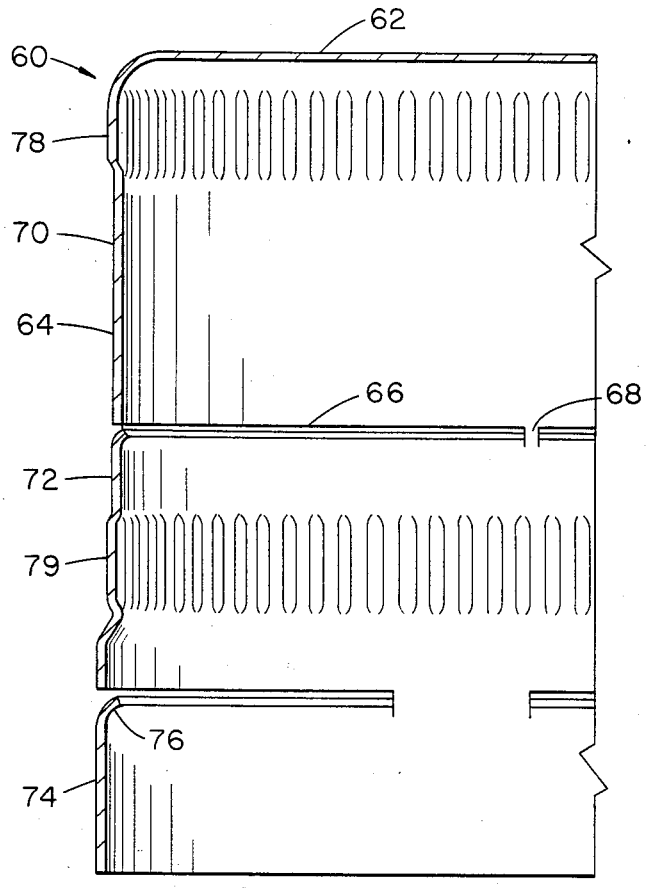
FIG. 1 is a cross section of one half of a device of this invention prior to application of the device to a fitment and container combination.
Figure 3:
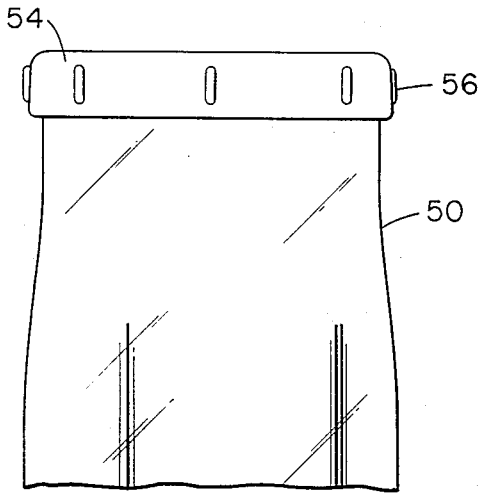
FIG. 3 is an elevational view of a neck portion of a container suitable for use with a device of this invention.
Figure 2:
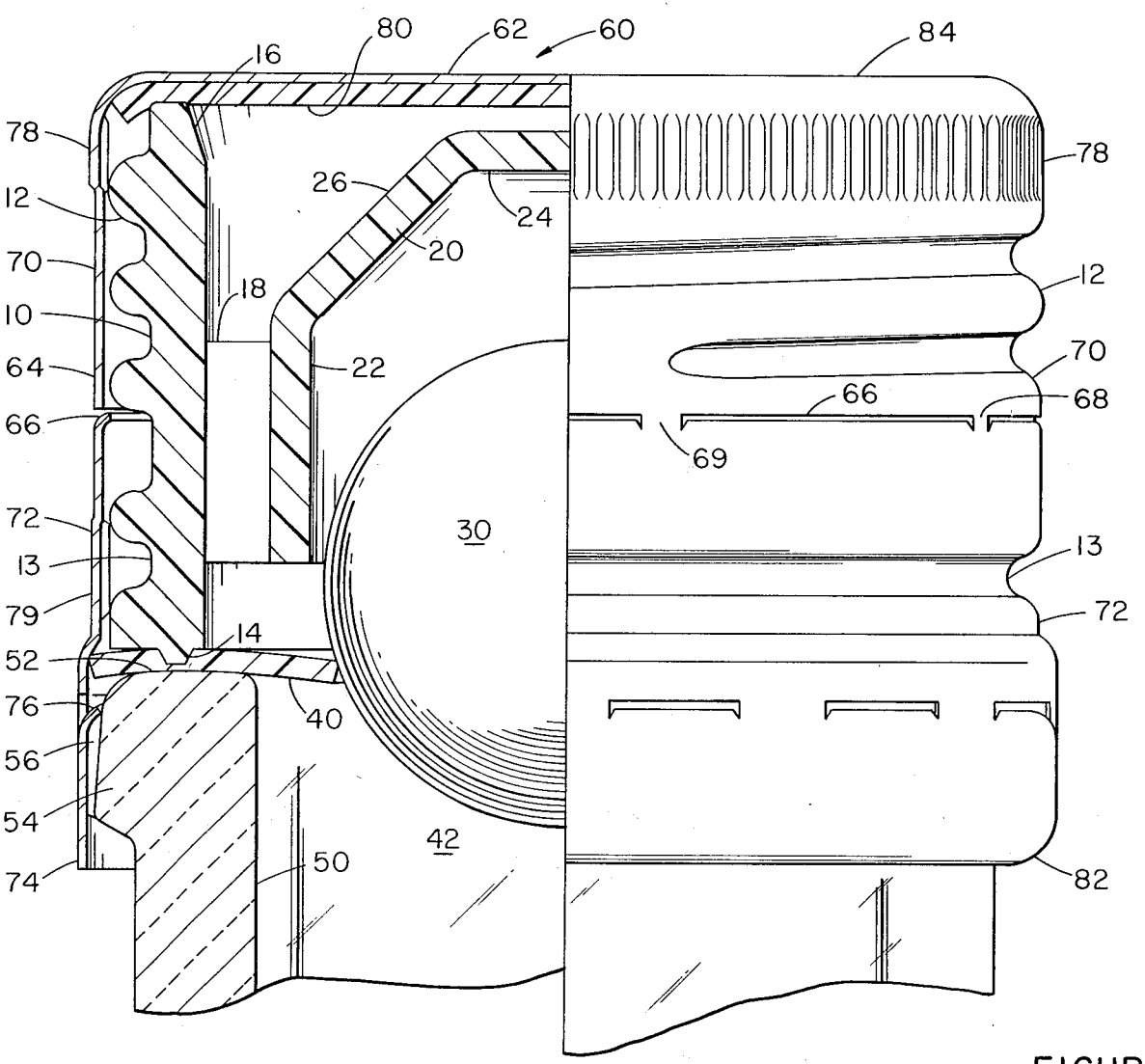
FIG. 2 is an elevational view of a half portion of a device of this invention assembled with a container having a fitment thereon and a cross section of a half portion of the device overlying the fitment positioned for attachment to the container.

A preferred embodiment of a device 60 of this invention is shown in FIG. 1, prior to assembly, and is comprised of a planar circular end wall 62 and depending skirt 64. The depending skirt 64 is substantially cylindrical and includes therein a line of weakness 66 in a portion of the skirt which lies between a first portion 70 which is rolled to engage the threads 12 on a fitment cylinder 10 as shown in FIG. 2 and a second portion 72 which is rolled to engage an annular groove 13 on the fitment cylinder 10 and functions as a sleeve to maintain the fitment and bottle in engagement, as will be explained later. The line of weakness 66 is provided by making an annular slit in the skirt 64 except for a plurality of unslit portions spaced around the circumference of the skirt wall. The unslit portions or bridges 68 thus serve as connections between the first and second skirt portions 70, 72. In this preferred embodiment, six bridges 68 are provided, all of equal size except for one which is greater in width than the remaining five. For purposes of this invention, however, as will be explained later, the number and width of the bridges 68 are a matter of choice except that it is preferred that at least one of the bridges is greater in width than the remaining bridges.

On a third portion 74 of the device 60, near the open end, a plurality of inwardly projecting tongues 76 are provided. In this preferred embodiment, six such tongues 76 are provided, but the number of tongues needed for purposes of this invention is a matter of choice, as will be explained later. To facilitate removal of the closure portion of the device 60 above the line of weakness 66 after assembly with the fitment housing 10 and bottle 50, as will now be explained, knurled surfaces 78 are provided on the first skirt portion 70. Knurled surfaces 79 are also provided on the second skirt portion 72 to assist in preventing rotation of the second skirt portion when the upper portion of the device 60 is being removed, as will be explained later.

To effect assembly of device 60 with the fitment 10 and bottle 50, the device 60, as just described, is provided with a suitable liner 80 adjacent to the interior surface of the device end wall 62 and is then positioned, as shown in FIG. 2, with the device 60 surrounding the fitment 10 and a portion of the bottle adjacent to the bottle mouth. The bottle 50 is provided with an annular flange 54 projecting outwardly from the bottle wall adjacent to the rim edge 52 surrounding the bottle mouth. Coincident with the spacing of the inwardly projecting flanges 76 of the device 60, outwardly projecting lugs 56 are provided around the outer surface of the bottle flange 54. To facilitate engagement of the tongues 76 with the lugs 56, the lugs may be of a considerably lesser width than the tongues.

By a known method, portions of the skirt 64 are formed by rollers to conform the skirt to the cylinder thread 12 and the annular groove 13, and a portion 82 of the skirt adjacent to the open end of the closure is bent inwardly under the bottle flange 54.

Figure 5:
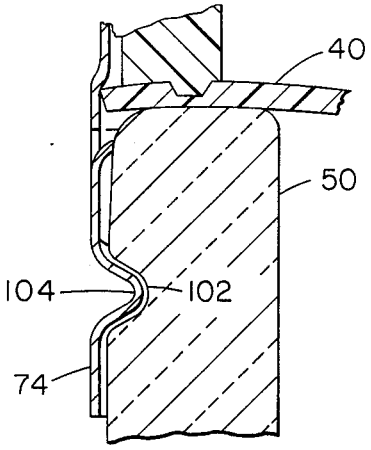
FIG. 5 is a cross section of a lower portion of the skirt of an alternate embodiment of a device of this invention in assembly with a portion of a fitment positioned on a container neck portion.

It may be seen that in forming the first skirt portion 70 to conform to thread 12 and forming the second skirt portion 72 to engage the annular groove 13, the bridges 68 are subject to a tensile force, and unless the bridges are of sufficient width, such tensile force will cause the bridges to fracture. Providing bridges 68 of sufficient width to resist fracture from such tensile force, however, is disadvantageous to facilitate removal of the closure because the greater the width of the bridges, the greater is the amount of torque required to break the bridges when removing the closure. By providing at least one bridge 69 having a width sufficient to provide a bridge with a cross section sufficient to withstand the tensile force without breaking, one or all of the remaining bridges may fracture without detriment to the function of the closure. As long as one bridge remains intact upon application of the closure, such a bridge is available to provide evidence that the closure has not been removed from the bottle. Thus, it may be seen that the smallest of the bridges provided need be only of a width sufficient to maintain assembly of the first and second portions 70, 72 of the skirt wall prior to engaging the device with the fitment 10. If desired, the third skirt portion 74 can be extended below the bent-in portion. Referring to FIG. 5, the bottle 50 has an annular groove 102 near the mouth of the bottle, and an annular ridge 104 on the third skirt portion 74 of the device is rolled into the groove. As may be seen from FIG. 5, this alternate embodiment makes it possible to extend the skirt to any desired length.

During bending of the skirt portion 82 under the bottle flange 54, the device 60 is drawn down tightly to compress the portion of the liner 80 disposed between the end wall 62 of the device and the surface of the rim edge of the dispensing end of the fitment 10. Drawing down the device 60 in the aforesaid manner also causes the annular fitment wedge 14 to embed into and compress the portion of the ball check seat 40 disposed between the wedge and the rim surface 52 of the bottle. Compression of the liner 80 and ball check seat 40, as just described, provides an effective seal between the device 60 and fitment cylinder 10 to protect the bottle content.

Bending the skirt wall portion 82 under the bottle flange 54 also functions to assist in maintaining assembly of the fitment with the bottle and breaking the bridges when the closure is removed, as will now be discussed.

To remove the closure portion of device 60, the closure is gripped and rotated, usually in a counterclockwise direction, with sufficient torque to break the bridges 69, 68 that have remained intact after assembling the closure with the fitment housing 10 and bottle 50, as has previously been described. The number and sizes of bridges 68, 69 necessary to provide an adequate connection between the first and second skirt portions 70, 72, both before and after assembling the closure with the fitment cylinder 10 and bottle 50, are a function of such things as the bottle diameter and the depth and extent of the thread 12 balanced against a reasonable torque requirement to remove the closure. The number and sizes of bridges 68, 69 can be determined for each specific application of this invention without undue experimentation.

As was noted earlier, bending the skirt wall portion 82 under the bottle flange 54 is of benefit in assisting to maintain an assembly of the fitment with the bottle and breaking the bridges upon removal of the closure. Forming the second portion of the skirt 72 into the annular groove 13 of the cylinder 10 when the closure is applied to the housing prevents the second skirt portion from moving vertically when the closure is rotated for removal. Engagement of the second skirt portion 72 into the annular groove 13 may also provide some assistance against rotation of the second skirt portion due to the frictional resistance between the housing groove and the skirt portion engaged therein. Additional resistance to rotation may be provided by including vertical grooves in the outwardly projecting cylinder portions adjacent the annular groove 13 for engagement with the knurls 79. It is desirable to prevent rotation of the second skirt portion 72 to aid in breaking the bridges 68, 69. As may best be seen in FIG. 2, when the device is positioned over housing 10 and bottle 50 prior to assembly therewith, the device is oriented in a manner such that tongues 76 overlay the outwardly projecting bottle lugs 56. When skirt portion 82 is bent under bottle flange 54 and drawn down in the process thereof, the tongues 76 are forced into a binding contact with lugs 56, and thus the second skirt portion 72 is restrained from rotation to assist breaking the bridges 68, 69 and facilitate removal of the closure portion 84 of the device above the weakened line 66.

With the upper portion 84 of the closure removed, housing 10 is held in assembly with the bottle 50 by the closure skirt portions engaged with annular groove 13 and bottle flange 54, and content of the bottle may now be dispensed in a usual pouring manner.

Figure 4:
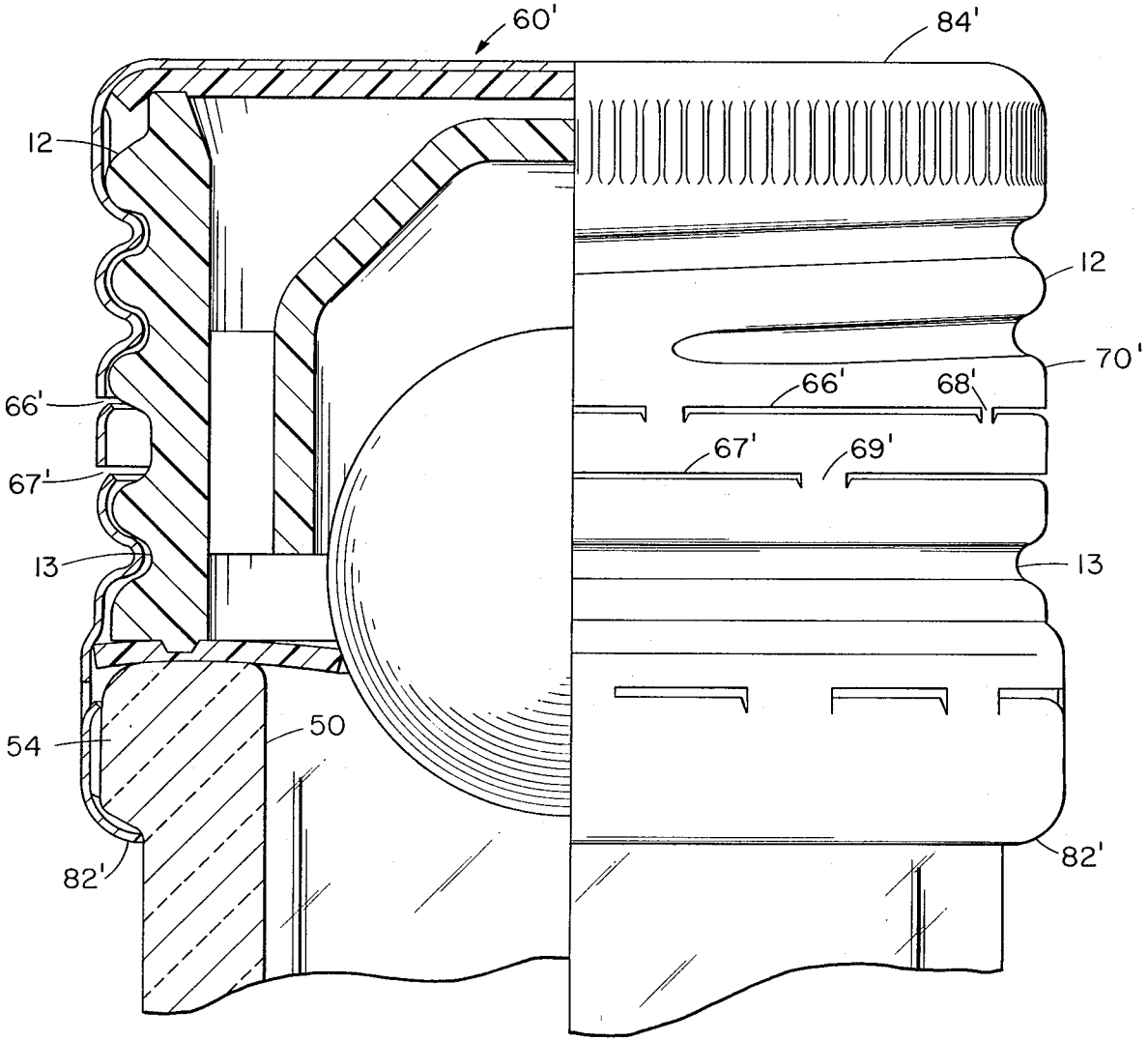
FIG. 4 is an elevational view of an alternate embodiment of a half portion of a device of this invention assembled with a container having a fitment thereon and a cross section of a half portion of the device overlying the fitment positioned for attachment to the container.

An alternate device 60' suitable for use in attaching a fitment of this invention to a bottle 50 is shown in FIG. 4. The alternate device 60' is similar in all respects to device 60 described in the foregoing discussion of a preferred embodiment except that the alternate device 60' includes, in addition to weakened line 66', a second weakened line 67'. In this alternate embodiment 60', the first weakened line 66' is comprised of an annular slit in an upper portion of skirt 70' except for a plurality of spaced apart bridges 68'. The second weakened line 67' is comprised of an annular slit spaced apart from the first weakened line 66', the slit being completely circumferential except for a plurality of bridges 69' which are spaced intermediate of the bridges 68' in the first weakened line 66'. The bridges 69' in the second weakened line 67' are of a greater width than the bridges 68' in the first weakened line 66'.

In using an alternate device 60' to secure a fitment of this invention to a bottle, it is positioned and formed to engage the thread 12 and annular groove 13 in a manner identical with that previously discussed in applying the device 60 to a preferred embodiment of the invention.

Again, it may be seen that the relatively severe forming required to thread roll, engage the skirt into the annular groove 13 and bend a portion 82' under bottle flange 54 induces a substantial tensile stress in the bridges 68', 69'. By staggering the bridges 68' in weakened line 66' with reference to bridges 69' in weakened line 67', however, the tensile stress is accommodated by opening the slit portions of lines 66', 67' opposite the bridges 68', 69' rather than fracturing the bridges. Since the bridges 69' in line 67' are wider than the bridges 68' in line 66', it may be seen that when torque is applied to remove an upper closure portion 84' of the device, the narrower bridges 68' fracture preferentially, and separation is effected along line 66'. The number, size and spacing of the bridges, as well as spacing of the lines of weakness, are a function of such things as the size of the device, depth of the thread, and depth of the annular groove in the fitment housing, for example, and such features can be determined for specific use applications without undue experimentation.

While the invention has been described in terms of preferred embodiments, the claims appended hereto are intended to encompass all embodiments which fall within the spirit of the invention.

What is claimed is:

1. A device for attaching a fitment to an open mouth container and for tamper-evident sealing said fitment attachment thereto, the device comprising:

an end wall;

a first skirt wall portion depending from said end wall and having a portion adapted for rolling a thread projecting inwardly into the device to threadably engage a cooperating threaded portion of said fitment;

a second skirt portion depending from said first skirt portion and connected thereto by a plurality of circumferentially spaced apart bridges which are adapted to fracture upon disengagement of the threadable engagement with at least one of the bridges having a greater width than any one of a remainder of the plurality of the bridges to thereby insure that at least one of the bridges will remain unbroken when said device is attached to said fitment and said container;

a third skirt portion depending from said second skirt portion;

means in said second skirt portion for providing engagement with said fitment to prevent vertical movement of said second skirt portion; and means in the third skirt portion for providing engagement with said container to secure said fitment in attached position with respect to said container.

2. A device as claimed in claim 1 wherein said means in said second skirt portion for engaging said fitment is a portion adapted for rolling at least one inwardly projecting ridge into at least one annular groove provided in said fitment.

3. A device as claimed in claim 1 wherein said means in said third skirt portion for engaging said container is a portion adapted for rolling a flange projecting inwardly into said device to engage a flange receiving portion of said container.

4. A device as claimed in claim 3 wherein the portion adapted for rolling a flange is an end portion of the third skirt portion which is adapted for rolling beneath an outwardly projecting flange on the container.

5. A device as claimed in claim 3 wherein the portion adapted for rolling a flange is a portion of the third skirt portion adapted for rolling into an annular groove in the container.

6. A device as claimed in claim 3 wherein said means in said third skirt portion for engaging said container further includes a plurality of circumferentially spaced tongues projecting inwardly into said device for engagement with portions of an outwardly projecting flange on the container.

7. A device as claimed in claim 1 wherein said second skirt portion includes a knurled surface in a portion thereof.

8. A device for attaching a fitment to an open mouth container and for tamper-evident sealing said fitment attached thereto, the device comprising:

an end wall;

a first skirt portion depending therefrom and having a portion adapted for rolling a thread projecting inwardly into the device to threadably engage a cooperating threaded portion of said fitment;

a second skirt portion depending from said first skirt portion and connected thereto by a plurality of frangible bridges adapted to fracture upon disengagement of the threadable engagement circumferentially spaced along a line of weakness with at least one of the bridges having a width greater than any one of the remainder of the bridge plurality to thereby insure that at least one of the bridges will remain unbroken when said device is attached to said fitment and said container and with the second skirt portion having a portion below the line of weakness adapted for rolling at least one rib projecting inwardly into said device to engage at least one annular groove provided in said fitment; and a third skirt portion depending from said second skirt portion with said third skirt portion having a plurality of circumferentially spaced tongues projecting inwardly into said device for engagement with a portion of a flange projecting outwardly from said container, and said third skirt portion also having a portion adapted for rolling a flange projecting inwardly into the device for engagement with the container flange.

9. A device for attaching a fitment to an open mouth container and for tamper-evident sealing said fitment attachment thereto, the device comprising:

an end wall;

a first skirt wall portion depending from said end wall and having a portion adapted for rolling a thread projecting inwardly into the device to threadably engage a cooperating threaded portion of said fitment;

a second skirt portion depending from said first skirt portion and connected thereto by a plurality of circumferentially spaced apart bridges in a line of weakening and adapted to fracture upon disengagement of the threadable engagement, and said second skirt portion further includes a second plurality of circumferentially spaced apart bridges disposed along a second line below the first line of circumferentially spaced apart bridges and with the second plurality of spaced apart bridges having a width greater than and disposed intermediate of the first circumferentially spaced apart bridges in the line of weakening;

a third skirt portion depending from said second skirt portion;

means in said second skirt portion for providing engagement with said fitment to prevent vertical movement of said second skirt portion; and means in the third skirt portion for providing engagement with said container to secure said fitment in attached position with respect to said container.

* * * * *